United States Patent [19]

Grüner et al.

[11] Patent Number: 4,989,116

[45] Date of Patent: Jan. 29, 1991

[54] CHOPPER CIRCUIT FOR DRIVING ELECTROMAGNET AND/OR STEP MOTOR COILS SUCH AS EMPLOYED IN A MATRIX PRINTER

[75] Inventors: Manfred Grüner, Ulm; Franz Riedl, Günzburg, both of Fed. Rep. of Germany

[73] Assignee: Mannesmann Aktiengesellschaft, Düseldorf, Fed. Rep. of Germany

[21] Appl. No.: 232,311

[22] Filed: Aug. 12, 1988

[30] Foreign Application Priority Data

Aug. 12, 1987 [DE] Fed. Rep. of Germany ..... 3727283

[51] Int. Cl.[5] ..... H01F 7/18

[52] U.S. Cl. ..... 361/154; 361/152

[58] Field of Search ..... 361/152, 154, 160, 182

[56] References Cited

FOREIGN PATENT DOCUMENTS 2828678 4/1980 Fed. Rep. of Germany .
3129610 2/1983 Fed. Rep. of Germany .
3438034 4/1986 Fed. Rep. of Germany .
3529742 2/1987 Fed. Rep. of Germany .
3530966 3/1987 Fed. Rep. of Germany .

*Primary Examiner*—A. D. Pellinen
*Assistant Examiner*—Jeffrey A. Gaffin
*Attorney, Agent, or Firm*—Horst M. Kasper

[57] ABSTRACT

A chopper circuit is provided for driving of electromagnets and/or step motor coils (8;26) in particular for a matrix printer, where the inductivity of the coil generates in connection with the applied voltage a maximum current, which current, however, is set lower by desired factor, whereby the current ripples (*7a*) are generated by chopping. These current ripples (*7a*) can be changed, that is, set to an optimum value depending on frequency inductivity and resistance of an electromagnetic coil (8) or, respectively, of a magnet coil winding (26). A driver circuit (9) for the electromagnetic coil (8) or, respectively, bridge circuit (27) for the step motor coil (26) have coordinated current data acquistion (10) with a current shut-off (11) in each case and that a digital control logic (12) is provided, which control logic generates a control signal (2) in the cycle of a shunted frequency generator, where the control signal (2) is present as an input and output signal at the input (13) of the driver circuit (9) or, respectively, of the bridge circuit, alternating with the current shut-off (11).

18 Claims, 2 Drawing Sheets

CHOPPER CIRCUIT FOR DRIVING ELECTROMAGNET AND/OR STEP MOTOR COILS SUCH AS EMPLOYED IN A MATRIX PRINTER

BACKGROUND OF THE INVENTION

1. Field of the Invention

The invention relates to a chopper circuit for driving of electromagnet and/or step motor coils, in particular as employed in a matrix printer, where the inductivity of the coils in connection with the applied voltage generates a maximum current, which maximum current, however, is set lower by a desired factor, where the current ripples can be generated by chopping.

2. Brief Description of the Background of the Invention Including Prior Art

The control and driving of electromagnetic coils in matrix print heads is performed with driver circuits, the purpose of which is to build up the magnetic field as quickly as possible and to let decay unavoidable counter inductions physically as quickly as possible during decline (German Patent DE-PS 31 39 502). In this context the object is desired to be able to pass renewed current through the electromagnetic coil in order to effect the renewed shooting of one and the same print needle in shorter time intervals, that is to achieve a quicker printing process.

Other solutions for the driving of electromagnetic coils in printers attempt to avoid an overcurrent passage (German Patent Application Laid Open DE-OS 31 51 242), in order to avoid the damaging lost heat in the coil. This lowering of the lost heat increases the lifetime of such matrix print heads.

It is a joint feature of the conventional solutions to keep the current flowing times as short as possible for reducing the lost heat and to allow a quick reinitiation of the current for a quick shooting of a printer needle.

Now, additional points of consideration have been found with regard to the requirement that different inductivities of electromagnetic coils and magnet coil windings in step motors require on the one hand an adaptation of the frequency and on the other hand the two types of coils can be driven in a system based on the same principals by one chopper circuit.

SUMMARY OF THE INVENTION

1. Purposes of the Invention

It is an object of the present invention to change current ripples generated during chopping depending on frequency, inductivity and resistance of an electromagnetic coil or, respectively, mangnetic coil winding, that is to set the ripples in an optimum way.

2. Brief Description of the Invention

According to the invention a chopper circuit for the driving of electromagnet and/or step motor coils such as employed in a matrix printer, includes a finally controlled element having an inductivity and having an input. A final control circuit has an output. The output of the final control circuit is connected to the input of the finally controlled element. A current data acquisition circuit includes a current shut-off for shutting of a current is connected to the final control ciruit. A pre-shunted frequency generator has an output for providing a clock cycle signal. A digital control logic has an input connected to the output of the pre-shunted frequency generator for generating a control signal with the clock cycle of the pre-shunted frequency generator.

The control signal is present as input or as output signal at an input of the final control circuit alternating with the shut-off of the current.

The finally controlled element can be comprised of a coil having an inductivity. The inductivity of the coil in connection with the applied voltage generates a maximum current, which current is set lower by a desired factor. Current ripples are generated by chopping. The digital control logic can be comprised of a reset/set flip-flop having a reset input and having a single output line. The single output line is coupled back to the reset input. The apparatus can include a reference voltage generator for generating a reference voltage and a sensor resistor. The current data acquisition circuit can be comprised of a comparator having an output. The positive input and having a negative input. The positive input of the comparator is connected to the reference voltage, the negative input of the comparator is connected to the sensor resistor, and the output of the comparator is connected to the digital control logic and to the input of the final control circuit.

The digital control logic preferably forms part of an application specific for integrated circuits ASIC. The final control circuit. The current data acquisition circuit, and the current shut-off are advantageously separately disposed. The digital control logic on the one hand and the current data acquisition or, respectively, the current shut-off as well as the final control circuit on the other hand, are preferably bi-directionally connected to each other. The final control circuit can be a driver circuit for an electromagnetic coil. The fianl control circuit can be a bridge circuit for a step motor coil.

The bridge circuit can be comprised of freewheeling diodes Amplifiers can be connected in each case between output lines of the digital control logic and transistors of the final control circuit.

According to the present invention a chopper circuit is provided where a driver circuit for the electromagnetic coil or, for a bridge circuit for the step motor coil is coordinated in each case to a current data acquisition with a current shot-off. A final control circuit is defined in the context of this invention as a driver circuit for the electromagnetic coil or, for a bridge circuit for the step motor coil. A digital control logic is provided, which generates in the cycle of a pre-shunted frequency generator, which control signal is present as input or as output signal at the input of a driver circuit or, respectively, of the bridge circuit alternating with the current shut-off. Based on the preset frequency, which is adapted to the inductivity and to the resistance of the coil, it is possible to generate an input or output signal at the input of the driver circuit or, respectively, of the bridge circuit. In other words, such a digital control logic together with this current data acquisition/current shut-off, allows to extend the operating range of the electromagnet or, respectively, step motor coils for different frequencies.

According to a further feature of the invention, the digital control logic comprises a reset/set flip-flop, where the single output line of the reset/set flip-flop is coupled back to the reset input. Based on this disclosure, there can be achieved a substantial saving in required lines, or, respectively, connection terminal poles. the line employed for this purpose as an input and output is associated with the advantage in connection with the use of an application specific integrated circuit, that only half of the otherwise required connection lines or, respectively, connection terminal poles are required.

It is further disclosed that the current data acquisition comprises a comparator, where the positive input of the comparator is connected to a reference voltage and where the negative input of the compartor is connected with a sensor resistor and where the output of the comparator is connected to the digital control logic and to the input of the driver circuit. Such circuit solution allows a minimum expenditure for the current data acquisition and the current shut-off.

According to a further improvement provided by the invention, the digital control logic is a part of an application specific integrated circuit and the driver circuit, the current data acquisition, and the current shut-off are separately disposed. Such a construction allows to provide the digital control logic as a component of a single chip.

Finally it is disclosed, that the digital control logic on the one hand and the current data acquisition or, respectively, the current shut off as well as the driver circuit on the other hand are bi-directional connected with each other.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a schematic chopper circuit as an application example for the electromagnetic coil of a print needle, of a print hammer or the like;

DESCRIPTION OF INVENTION AND PREFERRED EMBODIMENT

Figure 1:
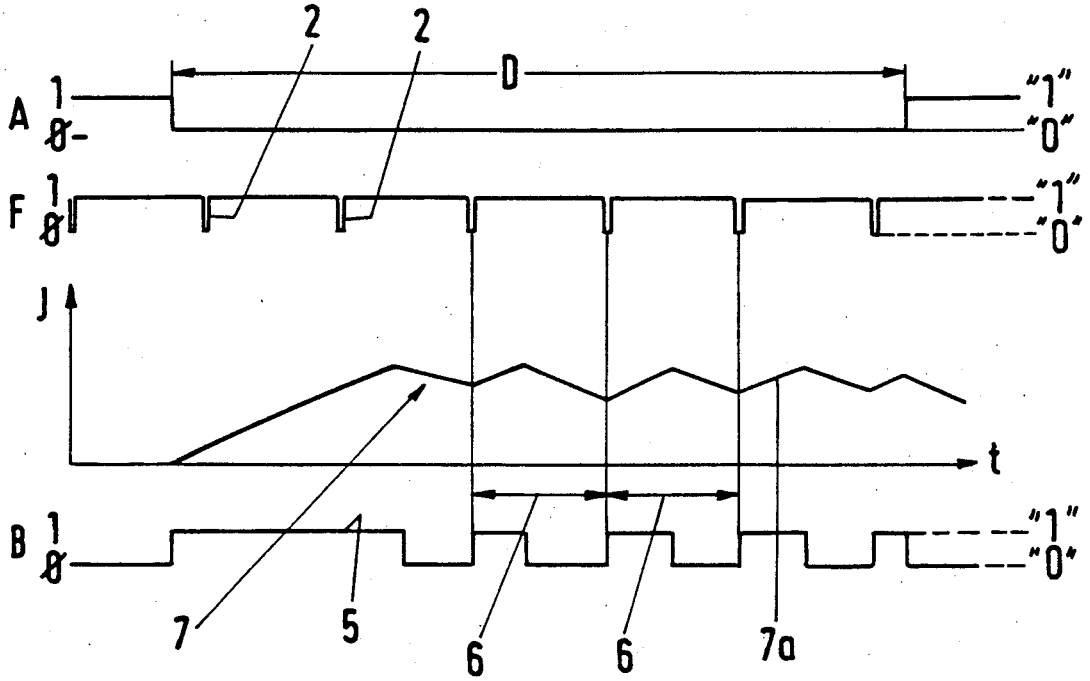
FIG. 1 is a schematic diagram illustrating the voltage or, respectively, current pulses depending on time.

In accordance with the present invention a chopper circuit is disclosed for the driving of electromagnet and/or step motor coils such as employed in a matrix printer, The inductivity of the coils in connection with the applied voltage generates a maximum current, which current, however, is set lower by a desired factor. The current ripples can be generated by chopping.

The improvement according to the invention includes that the driver circuit 9 for the electromagnetic coil 8 or, respectively, the bridge circuit 27 for the step motor coil 26 in each case are coordinated to a current data acquisition 10 with a current shut-off 11 and that a digital control logic 12 is provided, which generates a control signal 2 with the cycle of a pre-shunted frequency generator 3, which control signal is present as input or as output signal at the input 13 of the dirver circuit 9 or, respectively of the bridge circuit 27, alternating with the shut-off of the current 11. The digital control logic can be comprised of a a reset/set flip-flop 14, and the single output line 15 is coupled back to the reset input 16. The current data acquisition 10 can be comprised of a comparator 17. The positive input 18 of the comparator 17 is connected to a reference voltage 19 and where the negative input 20 of the comparator 17 is connected to a sensor resistor 21 and the output 22 of the compartor 17 is connected to the digital control logic 12 and to the input 13 of the driver circuit 9. The digital control logic 12 preferably forms part of an application specific for integrated circuits ASIC. The driver circuit 9, the current data acquisition 10 and the current shut-off 11 are advantageously separately disposed. The digital control logic 12 on the one hand and the current data acquisition 10 or, respectively, the current shut-off 11 as well as the dirver circuit 9 on the other hand, can be bi-directionally connected to each other.

According to a further aspect of the invention, a chopper circuit for the driving of electromagnet and/or step motor coils such as employed in a matrix printer, is disclosed A third gate has a first input, a second input and an output. A first input is provided for a pulse chain. A frequency generator has an output.

A first gate has a first input, a second input and an output. The first input of the first gate is connected to the output of the frequency generator and the output of the first gate is connected to the second input of the third gate.

A second gate has a first input, a second input and an output. The first input of the second gate is connected to the output of the first gate and the output of the second gate is connected to the input of the third gate.

A fourth gate has a first input, a second input and an output. The output of the second gate is connected to a second input of the second gate and a first input of the fourth gate is connected to the frequency generator.

A sixth amplifier has an input and an output. The input of the sixth amplifier is connected to the output of the third gate. A fifth amplifier has an input and an output. The input of the fifth amplifier is connected to the output of the sixth amplifier and the output of the fifth amplifier is connected to a second input of the fourth gate. A transistor has a base, an emitter and a collector, and the base can be connected to the output of the sixth amplifier. A comparator has a first input, a second input and an output. The output of the comparator is preferably connected to the base of the transistor and an output of the transistor is connected to a first input of the comparator. A reference voltage is connected to the second input of the comparator. An electromagnetic coil connected to the collector. An inverting amplifier preferably has an input and has an output connected to the base of the transistor. A free-wheeling diode can be connected to the output of the comparator and to the input of the inverting amplifier. An inverter can be connected in series with the fifth amplifier.

Figure 2:
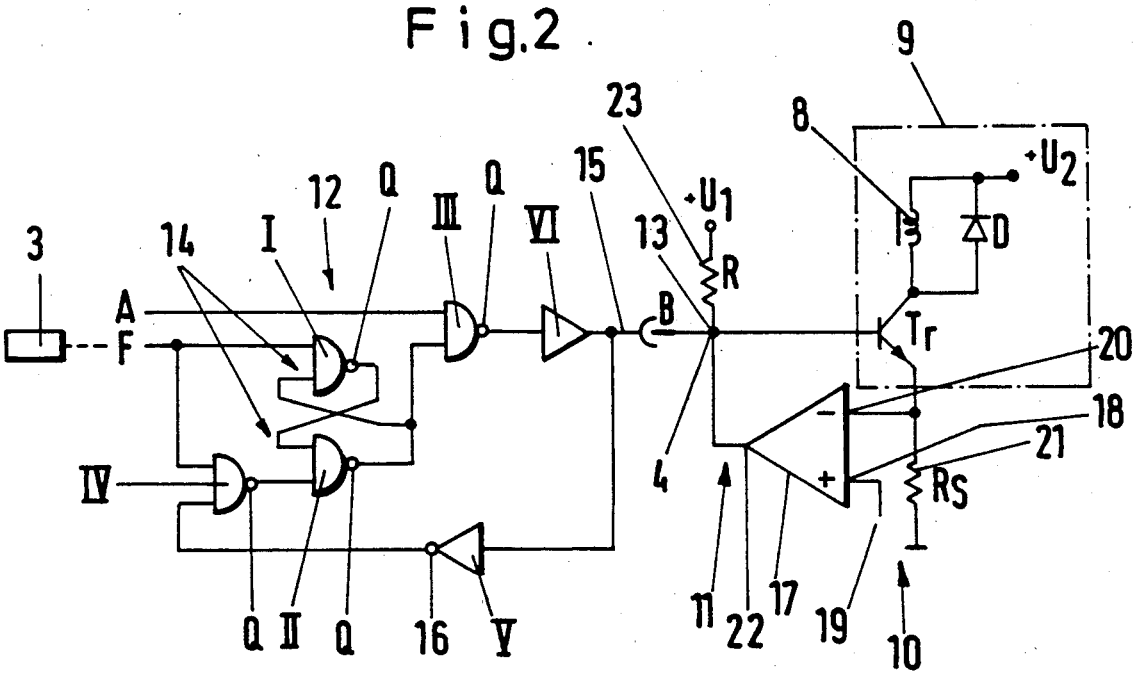

The pulse curve A in FIG. 1 generates at the higher level a logic "1" and at the lower level a logic "0". The time period of the pulse is selected with D=250 microsecond duration as an example for a matrix print head. The frequency pulse curve F illustrates the presently set frequency via negative control signals 2. The respective frequency generator 3 is indicated in FIG. 2. The frequency generator 3 generates a constant frequency.

The voltage pulse curve B is present at the output 4 as an on-signal, a logic 1 or as an off-signal logic "0". After the tranient oscillation build up 5 equal size voltage pulses 6 are present. Correspondingly, the chopper curve J illustrates the voltage course according to the voltage pulse curve B of a chopped current course 7 with current ripples 7a.

The chopper circuit for a print needle electromagnetic coil 8 with an inductivity as illustrated in FIG. 2 comprises a driver circuit 9 with a driver transistor Tr, current data acquisition 10 with a current shut off 11 and finally a digital control logic 12. The frequency generator 3 generates the negative control signal 2 at constant time periods intervals, which intervals can be set via the frequency generator 3. Consequently, in each case an in-, an on- or an off-signal is present at the output 4, which output 4 simultaneously forms the input 13 of the driver circuit 9. The digital control logic 12 comprises a reset/set flip-flop 14, which is provided with a single output line 15, which output line 15 is coupled back to reset- input 16.

The current data acquisition 10 comprises a comparator 17, where a reference voltage 19 is connected to the positive input 18 of the comparator 17 and where the negative input 20 of the comparator 17 is connected to a sensor resistor 21 (Rs). The output 22 of the comparator 17 is connected to the digital control logic 12 and to the input 13 of the drive circuit 9. The digital control logic 12 is part of an application specific integrated circuit ASIC the driver circuit 9, the current data acquisition 10 and the current shut-off 11, however, are separate on a printed circuit board of a matrix printer. The digital control logic 12 on the one hand and the current data acquisition 10, or, respectively the current shut off 11 and the driver circuit 9 are connected to each other bi-directionally.

The pulse curve signal A is switched to logic "1" in the base state of the chopper circuit illustrated in FIG. 2. The negative control signals 2 effect, that a gate output I is set to logic "1" and the gate output II is set to logic "0". The signal at the input 13 of the driver circuit 9 (compare voltage pulse curve B) is otherwise also set to logic "0" such, that the following driver circuit 9 remains inactive. In the case, that the signal of the pulse curve A, controlled by a data source or a signal generator is set to logic "0", and that the output "Q" of a gate II is set to logic "0", then the output Q of gate III is set to logic 1 and also the output Q of a gate VI, if this output is switched with a pull-up resistor 23 and if this output is connected with a higher voltage + U1.

The output 22 of the comparator 17 in such case is of high resistance, because in this time point no current flows in the driver circuit. Consequently the driver circuit 9 is activated. The current increases in the driver circuit 9 and effects a voltage drop at the sensor resistor 21 (Rs), which voltage drop pulls after reaching of the reference voltage 19 the output 22 of the comparator 17 to logic "0" and which pulls the output 4 as well as the gate input V also to a logic "0". The driver circuit 9 now is inactive again, where the current decreases according to an exponential function again in the electromagnetic coil 8. Simultaneously the reset/set flip-flop 14 comprising the gates I and II is reset again via the gates IV and V. This means that the signal (Q) becomes logic "1" and switches the output of the gate VI to logic "0". The current now interrupted in the driver circuit 9, or, respectively, in the sensor resistor 21 switches the comparator output 22 again to a high resitance state, whereby, however, the output of the gate VI maintains the signal level at logic "0".

This blocking stage of the driver circuit 9 remains stable so long until a signal of the frequency pulse curve F occurs based on a short set pulse of about 500 nsec for the reset/set flip-flop 14. The reset/set flip output signal (Q) is then again logical "0" and consequently the output of the gate III is logic "1". This way the driver circuit 9 is again active. This alternation is maintained until the pulse of the pulse curve A becomes again logic "1" and the driver circuit 9 is set inactive via a signal of the voltage pulse curve B with the logic level "0".

Figure 3:
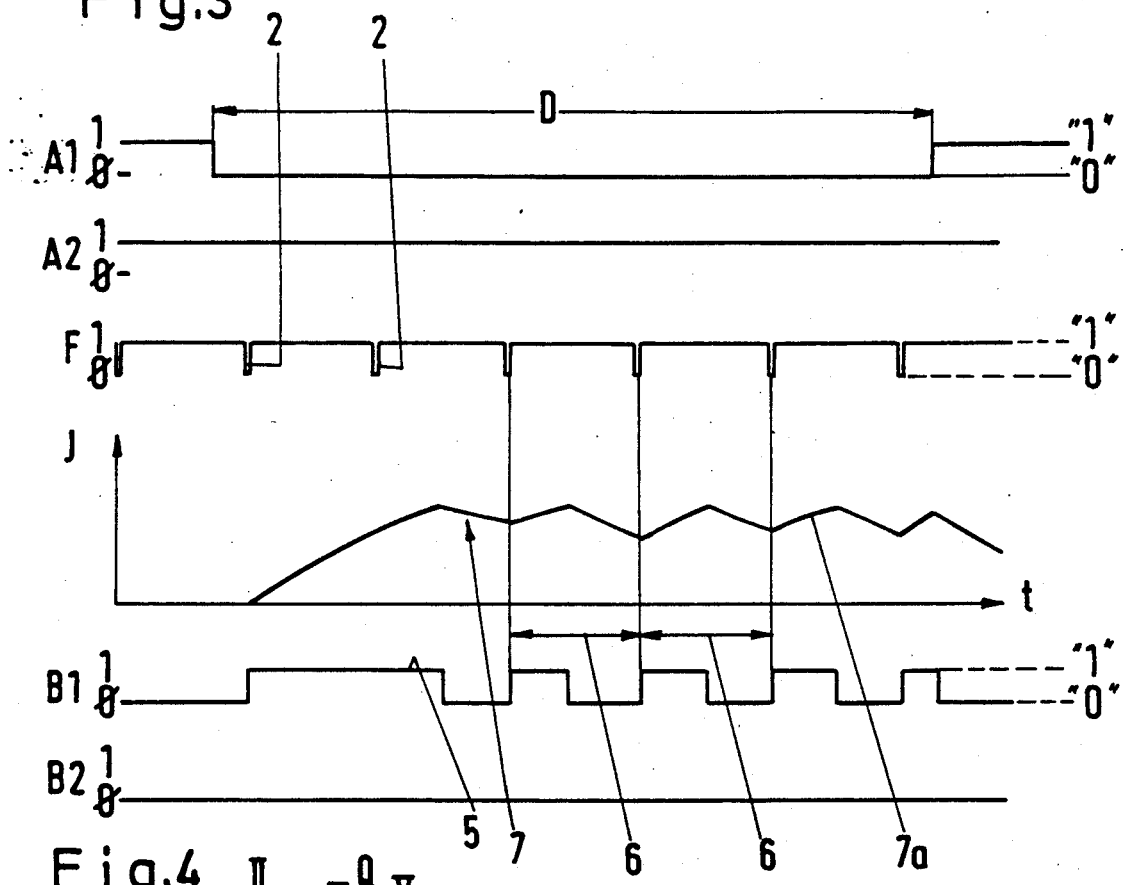
FIG. 3 is a schematic diagram illustrating the dependence of voltage or, respectively, of current pulses of a stepmotor on time.
Figure 4:
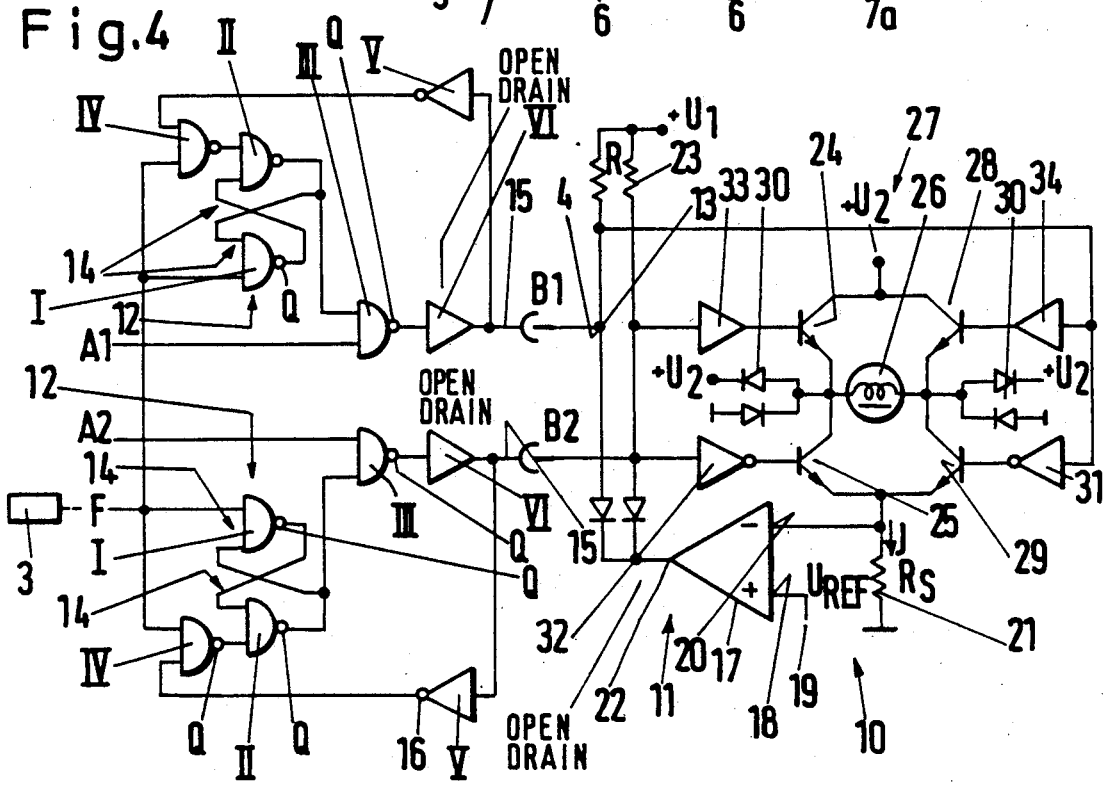
FIG. 4 is a schematic diagram of a chopper circuit for the application at a step motor coil.

The chopper circuit for a step motor magnet coil 26 as illustrated in FIG. 4 operates as described above. The reference numerals employed in FIG. 1 and the description relative thereto also holds for FIG. 3.

The chopper circuit for a step motor is illustrated in FIG. 4. The same reference numerals as in FIG. 2 also holds for FIG. 4 as well as the description belonging to FIG. 2. The digital control logic 12 is present twice for the driving of a step motor for each step motor magnet coil 26. Correspondingly, the pulse curves A1 and A2 are present. Consequently, there are also two voltage pulse curves B1 and B2 present. Each step motor magnet coil 26 forms a bridge circuit 27. A bridge branch, considered in FIG. 3 is formed by the transistors 24 and 29 or, respectively, 25 and 28. In each case freewheeling diode pairs 30 are connected to the step motor magnet coils 26. Inverting amplifiers 31 and 32 or, respectively, non-inverting amplifiers 33 and 34 are connected in each case between the output lines 15 and the transistors 24, 29 or, respectively 25 and 28.

It will be understood that each of the elements described above, or two or more together, may also find a useful application in other type of chopper system configurations and electromagnet coil and step motor coil power feeding procedures differing from the types described above.

While the invention has been illustrated and described as embodied in the context of a chopper circuit for drivig electromagnet and/or step motor coils such as employed in a matrix printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential charactristics of the generic or specific aspects of this invention.

What is claimed as new and desired to be protected by Letters Patent is set forth in the appended claims.

We claim:

1. A chopper circuit for the driving of electromagnetic coils and/or step motor coils such as employed in a matrix printer, comprising finally controlled element having an inductivity and having an input;

a final control circuit having an input and an output, where the output of the final control circuit is connected to the input of the finally controlled element;

a current data acquisition circuit including a current shut-off for shutting off a current and the current shut-off connected to an input of the final control circuit;

a frequency generator having an output for providing a clock cycle signal;

a digital control logic having an input connected to the output of the frequency generator generating a control signal with the clock cycle of the frequency generator, which control signal is present as input or as output signal at the input of the final control circuit alternating with the shut-off of the current.

2. The chopper circuit according to claim 1 wherein the finally controlled element comprises a coil having an inductivity and where the inductivity of the coil in connection with the applied voltage generates a maximum current, which current is set lower by a desired factor and where current ripples are generated by chopping.

3. The chopper circuit according to claim 1
wherein the digital control logic comprises a reset/set flip-flop having a reset input and having a single output line; and
wherein the single output line is coupled back to the reset input.

4. The chopper circuit according to claim 1 further comprising
a reference voltage generator for generating a reference voltage;
a sensor resistor;
wherein the current data acquisition circuit comprises a comparator having an output, having a positive input and having a negative input;
wherein the positive input of the comparator is connected to the reference voltage;
wherein the negative input of the comparator is connected to the sensor resistor; and
wherein the output of the comparator is connected to the digital control logic and to the input of the final control circuit.

5. The chopper circuit according to claim 1
wherein the digital control logic forms part of an integrated circuit, and
wherein the final control circuit, the current data acquisition circuit, and the current shut-off are separately disposed.

6. The chopper circuit according to claim 5
wherein the digital control logic and the current data acquisition are bidirectionally connected to each other and
wherein the current shut-off and the final control circuit are bidirectionally connected to each other.

7. The chopper circuit according to claim 1
wherein the final control circuit is a driver circuit for the finally controlled element.

8. The chopper circuit according to claim 1
wherein the final control circuit is a bridge circuit for a step motor coil.

9. The chopper ciruit according to claim 8
wherein the bridge circuit comprises freewheeling diodes and
wherein amplifiers are connected in each case between output lines of the digital control logic and transistors of the final control circuit.

10. A chopper circuit for the driving of electromagnetic coils and/or step motor coils such as employed in a matrix printer, where the inductivity of the coils in connection with the applied voltage generates a maximum current, which current, however, is set lower by a desired factor, where the current ripples can be generated by chopping, the improvement comprising a driver circuit (9) having an input (13) and for driving an electromagnetic coil (8) or, respectively, a bridge circuit (27) for a step motor coil (26) in each case coordinated to a current data acquisition (10) with a current shut-off (11) connected to the input (13) of the driver circuit (9),
wherein a digital control logic (12) is provided, which generates a control signal (2) in the cycle of a frequency generator (3), which control signal (2) is present as input signal or as output signal at the input (13) of the driver circuit (9) or, respectively of a bridge circuit (27), alternating with the current shut-off (11).

11. The chopper circuit according to claim 10,
wherein the digital control logic (12) comprises a reset/set flip-flop (14), where a single output line (15) of the reset/set flip-flop (14) is coupled back to a reset input (16).

12. The chopper circuit according to claim 10,
wherein the current data acquisition (10) comprises a comparator (17), where a positive input (18) of the comparator (17) is connected to a reference voltage (19), and where a negative input (20) of the comparator (17) is connected to a sensor resisitor (21), and where an output (22) of the comparator (17) is connected to the digital control logic (12) and to the input (13) of the driver circuit (9).

13. The chopper circuit according to claim 10,
wherein the digital control logic (12) forms part of an integrated circuit, and
wherein the driver circuit (9), and the current data acquisition (10) as well as the current shut-off (11) are separately disposed.

14. The chopper circuit according to claim 13,
wherein the digital control logic (12) and the current data acquisition (10) are bidirectionally connected to each other and
wherein the current shut-off (11) and the driver circuit (9) are bi-directionally connected to each other.

15. A chopper circuit for the driving of electromagnet and/or step motor coils such as employed in a matrix printer, comprising
a third gate having a first input, a second input and an output, where a first input is provided for a pulse chain;
a frequency generator having an output;
a first gate having a first input, a second input and an output, where the first input of the first gate is connected to the output of the frequency generator and where the output of the first gate is connected to the second input of the third gate;
a second gate having a first input, a second input and an output where the first input of the second gate is connected to the output of the first gate and where the output of the second gate is connected to the second input of the third gate and to the second input of the first gate;
a fourth gate having a first input, a second input and an output where the output of the second gate is connected to a second input of the second gate and where a first input of the fourth gate is connected to the frequency generator;
a sixth amplifier having an input and an output, where the input of the sixth amplifier is connected to the output of the third gate;
a fifth amplifier having an input and an output, where the input of the fifth amplifier is connected to the output of the sixth amplifier and where the output of the fifth amplifier is connected to a second input of the fourth gate ;

a step motor including an electromagnetic coil connected to the output of a sixth gate.

16. The chopper circuit according to claim 15 further comprising an inverter connected in series with the fifth amplifier.

17. A chopper circuit for the driving of electromagnet and/or step motor coils such as employed in a matrix printer, comprising a third gate having a first input, a second input and an output, where a first input is provided for a pulse chain;

a frequency generator having an output;

a first gate having a first input, a second input and an output, where the first input of the first gate is connected to the output of the frequency generator and where the output of the first gate is connected to the second input of the third gate;

a second gate having a first input, a second input and an output where the first input of the second gate is connected to the output of the first gate and where the output of the second gate is connected to the second input of the third gate and to the second input of the first gate;

a fourth gate having a first input, a second input and an output where the output of the second gate is connected to a second input of the second gate and where a first input of the fourth gate is connected to the frequency generator;

a sixth amplifier having an input and an output, where the input of the sixth amplifier is connected to the output of the third gate;

a fifth amplifier having an input and an output, where the input of the fifth amplifier is connected to the output of the sixth amplifier and where the output of the fifth amplifier is connected to a second input of the fourth gate;

a transistor having a base, an emitter and a collector, where the base is connected to the output of the sixth amplifier;

a comparator having a first input, a second input and an output, where the output of the comparator is connected to the base of the transistor and where an output of the transistor is connected to a first input of the comparator and where a reference voltage is connected to the second input of the comparator; and an electromagnetic coil connected to the collector.

18. The chopper circuit according to claim 17 further comprising an inverting amplifier having an input and having an output connected to the base of the transistor;

a free-wheeling diode connected to the output of the comparator and to the input of the inverting amplifier.

* * * * *